US007014075B2

(12) United States Patent
Bonifacio et al.

(10) Patent No.: US 7,014,075 B2
(45) Date of Patent: Mar. 21, 2006

(54) FLOW CONTROL CLOSURE

(75) Inventors: Eduardo Mingo Bonifacio, Sant Vicenc De Montalt (ES); Antonio Motilla Gonzalez, Barcelona (ES); Felip Jornet Grino, Sabadell (ES)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/469,583

(22) PCT Filed: Feb. 25, 2002

(86) PCT No.: PCT/EP02/02004

§ 371 (c)(1),
(2), (4) Date: Mar. 16, 2004

(87) PCT Pub. No.: WO02/074650

PCT Pub. Date: Sep. 26, 2002

(65) Prior Publication Data

US 2004/0155072 A1 Aug. 12, 2004

(30) Foreign Application Priority Data

Mar. 2, 2001 (EP) ..... 01301941

(51) Int. Cl.
*B65D 47/00* (2006.01)

(52) U.S. Cl. ..... 222/503; 222/547; 222/548; 222/564

(58) Field of Classification Search ..... 222/486, 222/502, 503, 547, 548, 564, 565
See application file for complete search history.

(56) References Cited

U.S. PATENT DOCUMENTS

| | | | | |
|---|---|---|---|---|
| 1,226,722 | A * | 5/1917 | Sullivan | 141/268 |
| 2,838,214 | A * | 6/1958 | Kimball | 222/502 |
| 3,029,003 | A * | 4/1962 | Gronemeyer | 222/545 |
| 3,311,275 | A | 3/1967 | Gibson | |
| 3,330,450 | A | 7/1967 | Clare | |
| 3,429,488 | A | 2/1969 | Micallef | |
| 3,570,727 | A | 3/1971 | Croyle | |
| 4,437,593 | A * | 3/1984 | Bullock, III | 222/153.07 |
| 4,444,328 | A * | 4/1984 | Glass | 215/230 |

FOREIGN PATENT DOCUMENTS

| | | |
|---|---|---|
| FR | 330192 | 3/2003 |
| GB | 980392 | 1/1965 |
| WO | WO 9616897 | 6/1996 |

* cited by examiner

*Primary Examiner*—Joseph A. Kaufman
(74) *Attorney, Agent, or Firm*—Diller, Ramik & Wigh

(57) ABSTRACT

A plastic closure for a container mouth is provided with a flow regulator for selectively controlling the flow of contents during dispensing. The flow regulator includes at least two parts which can be moved relative to each other. Each part has at least one dispensing orifice. The parts are constructed such that respective orifices can be aligned at least partially with respect to each other and with respect to the container mouth. The degree of overlap between the respective orifices defines a common dispensing area to control the flow rate during contents dispensing.

11 Claims, 4 Drawing Sheets

FLOW CONTROL CLOSURE

BACKGROUND OF THE INVENTION

The present invention relates generally to a plastics closure for a container and specifically to a plastics closure having some means of regulating the outflow of the contents of a container to which it is attached.

In many cases it is desirable for some form of control to be exercised over the outflow of contents from a container. For example, many containers intended to hold herbs or spices have covers over their mouth with a plurality of openings which restrict the dispensing area of the container mouth from which contents can outflow. However, the dispensing area is fixed and cannot be changed to select a different flow rate. In general, plastic closures which have a flow regulation feature of some sort have very much a binary operation, either closing the container or e.g. lifting, rotating or being removable to open the container to a fixed and unadjustable extent.

SUMMARY OF THE INVENTION

Accordingly therefore, the present invention provides a plastics closure for a container mouth having flow regulation means for selectively controlling the flow rate of contents dispensed from the container, the flow regulation means comprising at least two parts which can be moved relative to one another, each part having at least one dispensing orifice, the parts being adapted so that their respective orifices can be aligned at least partially with respect to each other and with the container mouth, the degree of overlap between the respective orifices defining a common dispensing area whereby to control the flow rate. The invention is characterised in that the parts are adapted to move relatively through a plurality if stable positions for pre-selection of fixed incremental flow rates.

The term flow rate can relate to a flow rate at any or a particular inclination of the container, or could relate to a maximum flow rate.

Movement of the parts through the plurality of stable conditions may be achieved using a ratchet arrangement.

In a preferred embodiment the relative movement of the parts is a rotational movement, although other forms of relative movement such as longitudinal or even arcuate might also be used.

The parts may be rotated to a stable position in which each of the dispensing orifices is substantially occluded, whereby to close container. In this way a separate lid may not have to be provided. In this case a separate sealing feature may be included such as a resilient sealing gasket. Additionally or alternatively of course, a lid may be provided and may be formed as an integral part of the closure.

At least one of the parts may be formed integrally with the main body of the closure and in a preferred embodiment a first part includes the closure skirt which engages the container, the orifice-including surfaces and the lid; the second part comprises orifice-containing surfaces in the form an insert which is rotatably mounted within the first part.

In a preferred embodiment both parts are conical, one forming a seat for the other. This form has been found to be particularly useful for achieving smooth content flow. Of course other shapes could be used, for example convex, concave, hemispherical or frustoconical. In a preferred embodiment the two parts are of complimentary shape and, to the extent that they overlap, are closely adjacent and may even seal to avoid ingress of contents between them. In embodiments where the shape of the two parts is complimentary, when they are assembled they may seal by geometrical interference.

The flow regulating dispensing orifices may simply be plain openings. In some embodiments it may be preferable, however, for the or each orifice to have an insert such as a filter, or a further flow regulation insert if particular types of flow are required.

Because of the generality of the principal of the present invention it could be applied to any type of fluid—liquids, gases, gels—or solids.

The present invention will now be more particularly described, by way of example, with reference to the accompanying drawings, in which;

DETAILED DESCRIPTION OF THE PREFERRED EMBODIMENTS

Figure 1:
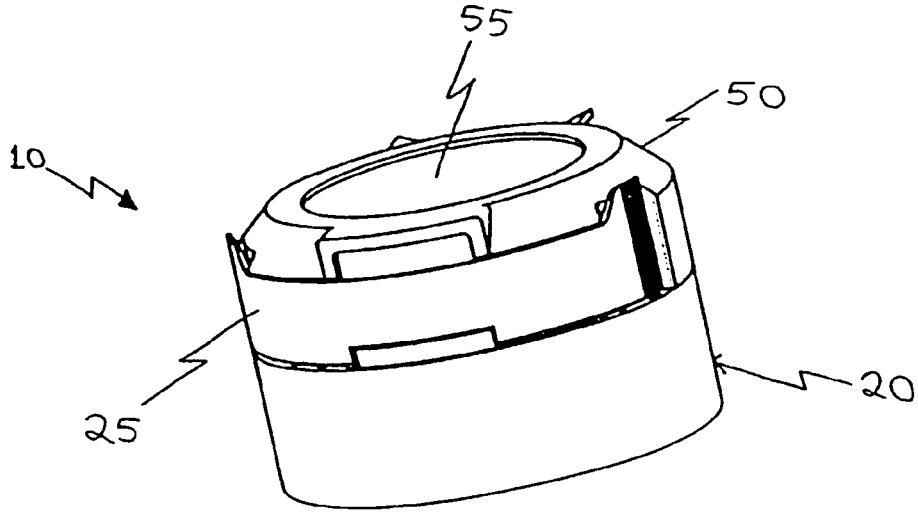
FIG. 1 is a perspective view of a plastics closure according to the present invention shown in a closed position.
Figure 2:
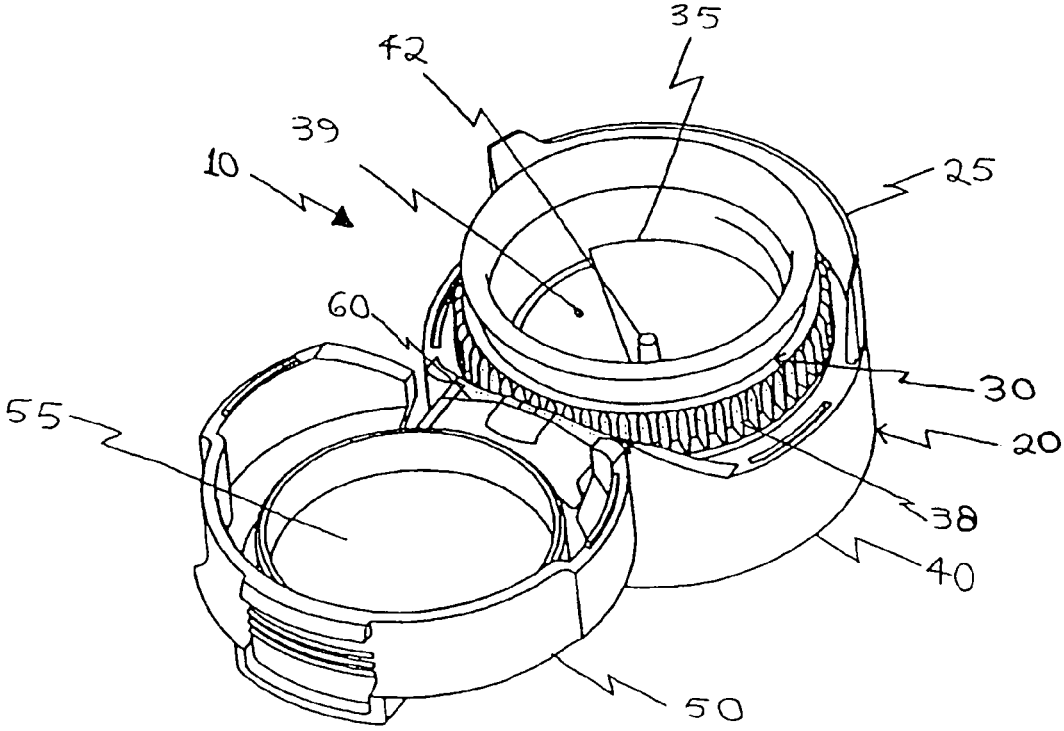
FIG. 2 is a perspective view of the plastics closure of FIG. 1 shown in an open position.

Referring first to FIGS. 1 and 2, there is shown a plastics closure generally indicated (10) comprising a first dispensing part (20) constituting a main body, and a second dispensing part (30) in the form of an insert. As can be seen in FIG. 1, when the closure is supplied it is in a closed position and the two parts (20), (30) are joined by a tamperevident band (25) which in this embodiment is an elongate arcuate tab that must be stripped away before the closure can be opened.

Figure 3:
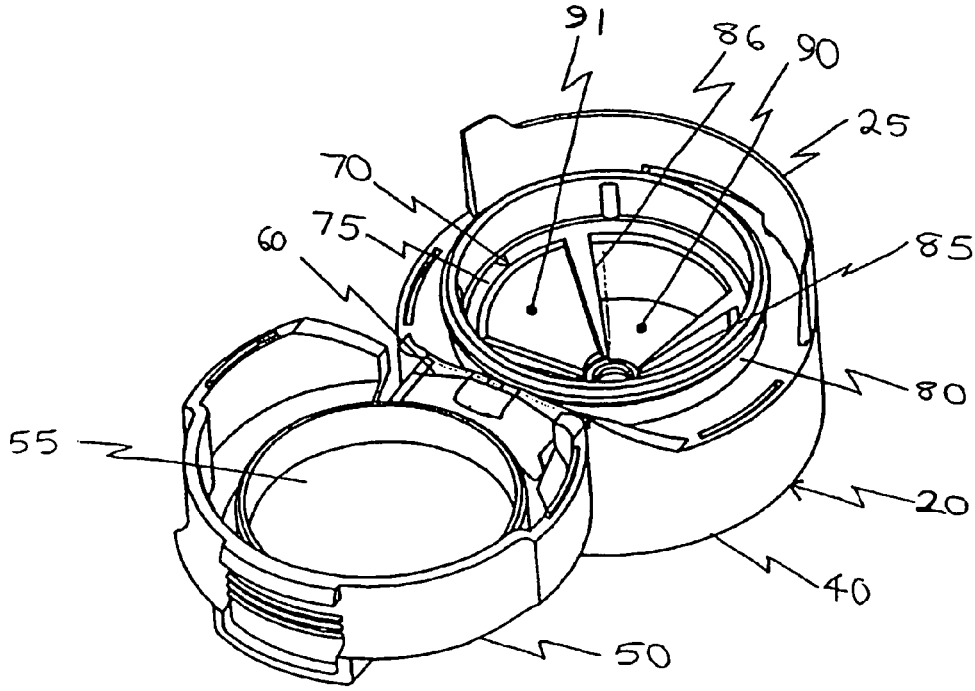
FIG. 3 is a perspective view of a first dispensing part of the closure shown in FIGS. 1 and 2.
Figure 7:
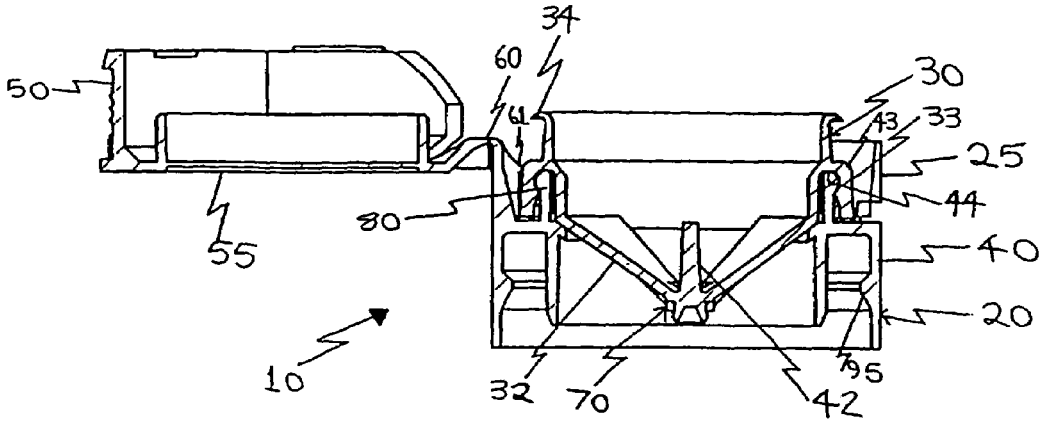
FIG. 7 is an axial section taken through the closure shown in FIG. 2.

Referring now to FIGS. 3 and 7, the first dispensing part (20) will now be more particularly described. The first dispensing part (20) comprises a tubular lower body portion (40) which is open at both ends, and a tubular upper body portion (50) which is closed at its upper end by a panel (55). The upper (50) and lower (40) body portions are joined by a hinge (60) and as such the upper body portion (50) forms a lid. The interior of the lower body portion (40) is occupied by a generally conical fixed cradle (70). Around the upper internal periphery of the lower body portion (40) is an annular upstanding rim (80). In this embodiment the cradle (70) is formed as an integral part of the lower body portion (40). In other embodiments the cradle (70) is a separate element which is secured within the lower body portion as the closure is assembled. The conical cradle (70) comprises a major support ring (75) which is substantially the same circumference as the lower body portion (40), and a minor support ring (85) which is only a fraction of the size of the major support ring and is displaced axially thereof. The major and minor rings (75, 85) are joined by inclined spokes (86) so as to form two diametrically opposed triangular orifices (90) therebetween (only one is visible in the Figure) which are spaced by solid triangular panels (91).

Figure 4:
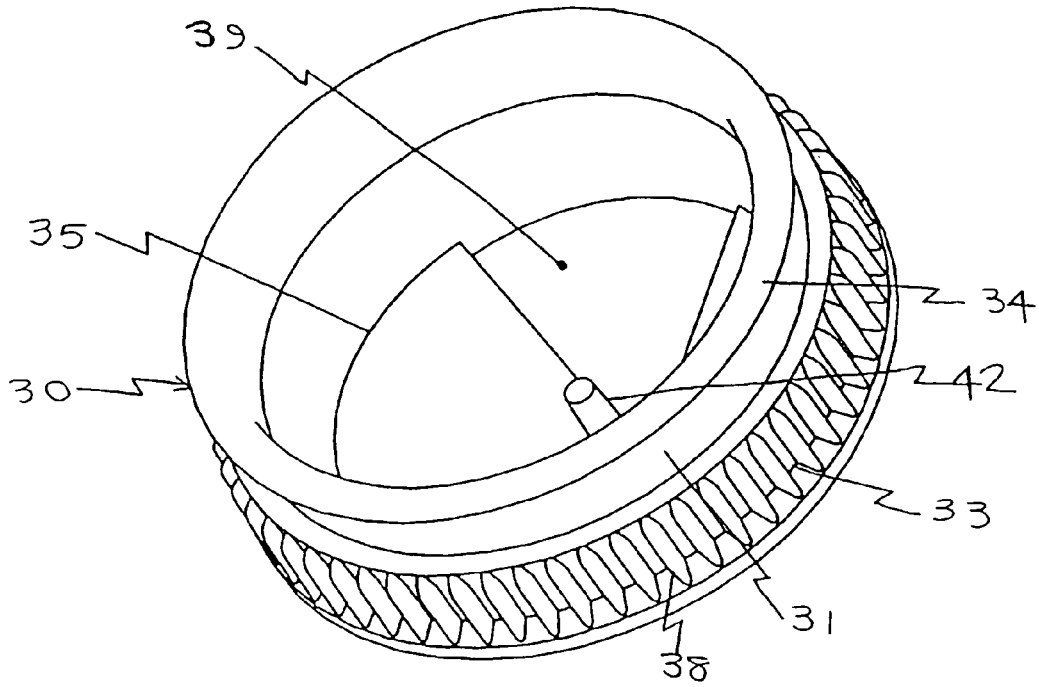
FIG. 4 is a perspective view of a second dispensing part of the closure shown in FIGS. 1 and 2.
Figure 5:
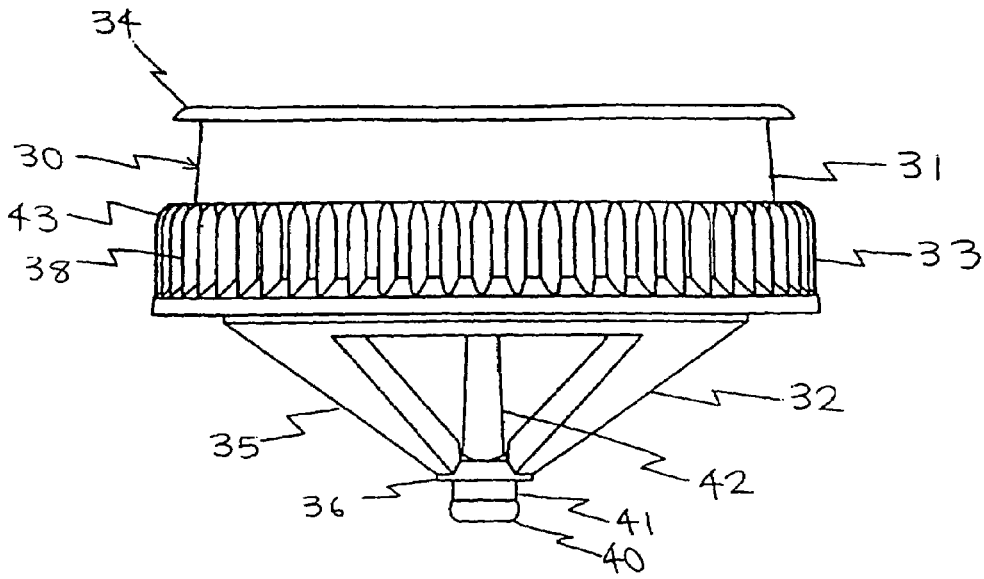
FIG. 5 is a side elevation of the second dispensing part shown in FIG. 4.
Figure 6:
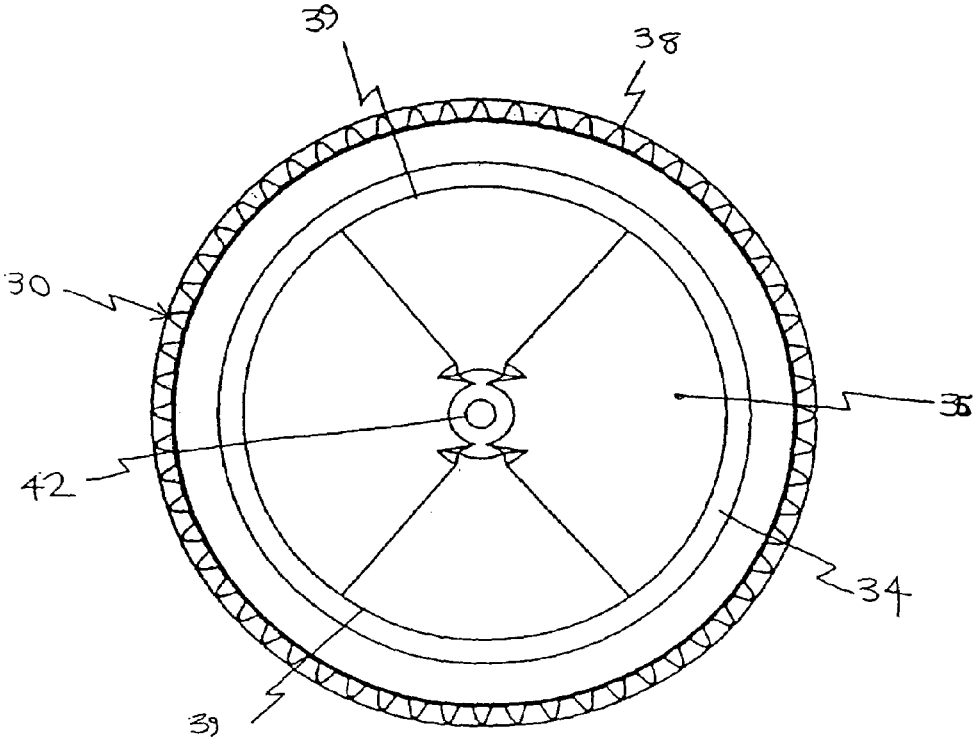
FIG. 6 is a plan view of the second dispensing part shown in FIGS. 4 and 5.

Referring now to FIGS. 4 to 6 the second dispensing part (30) will now be more particularly described. The second dispensing part (30) comprises a tubular upper body portion (31) and a conical lower body portion (32). An intermediate portion (33) joins the upper and lower body portions. The top of the upper body portion (30) is outwardly flared to form a pouring lip (34). In a similar configuration to the conical cradle (70) of the first dispensing part (20), the lower body portion (32) of the second dispensing part (30) comprises spokes (35) which extend from the intermediate body portion (33) downwardly and inwardly towards a hub (36). The hub (36) is connected to a bulbous cylindrical lower end (40) via a cylindrical spindle (41) of slightly smaller diameter. In addition, a flow-controlling spike (42) extends upwardly from the hub (36). The triangular spokes (35) of the lower body portion therefore also define two diametrically opposed triangular orifices (39). The intermediate body portion (33) is an annulus with inner and outer walls joined by a shoulder (43) to define a cavity (44).

FIGS. 2 and 7 show the first and second dispensing parts assembled to form the closure (10). To assemble the closure (10) the lower end (40) of the hub (36) is snap engaged into the minor support ring (85) and the middle body portion (33) is pushed over the upstanding ring (80). As can be appreciated from FIG. 5, once the lower end (40) has been snapped engaged into the minor support ring (85), the second disensing part (30) can be rotated with respect to the insert of the first dispensing part (20) about the spindle (43). In this way the orifices (39), (90) can be aligned to a greater or lesser extent. The rate of outflow through the common opening created by overlap between the orifices (39), (90) can be controlled by relative rotation of the two dispensing parts. To control the relative rotation of the two parts the first dispensing part is provided with a tooth (61) (shown best in FIG. 7) which meshes with the teeth (38) of the middle part of the second dispensing part. This ratchet arrangement allows any overlap between the orifices of the first and second parts to be selected and maintained.

The first part (20) is provided with an annular bead (95) which allows the closure to be snap-fitted over a container with a corresponding bead. Of course, other methods of engaging the closure on the container could be used, such as screw threads.

Although a preferred embodiment of the invention has been specifically illustrated and described herein, it is to be understood that minor variations may be made in the apparatus without departing from the spirit and scope of the invention, as defined by the appended claims.

What is claimed is:

1. A plastic closure for a container mouth comprising flow regulation means for selectively controlling the flow of contents dispensed from the container, the flow regulation means including at least two parts which can be moved relative to one another, each part having at least one dispensing orifice, the parts being adapted such that their respective orifices can be aligned at least partially with respect to each other and with the container mouth, the degree of overlap between the respective orifices defining a common dispensing area thereby to control the flow rate, cooperative means defined by the parts for selectively effecting a plurality of discreet individually distinct stable positions of orifices overlap for pre-selection of fixed incremental contents flow rates, at least one of the parts being of a conical configuration, and the conical configuration of the at least one part convergingly tapers in a direction toward an interior of the container.

2. The plastic closure as defined in claim 1 wherein said cooperative means is a ratchet arrangement.

3. The plastic closure as defined in claim 1 wherein the parts are rotatable relative to one another.

4. The plastic closure as defined in claim 1 wherein said cooperative means is a ratchet arrangement and the parts are rotatable relative to one another.

5. The plastic closure as defined in claim 1 including a lid for closing at least one of the parts.

6. The plastic closure as defined in claim 1 including a main body, and at least one of the parts is formed integrally with the main body.

7. The plastic closure as defined in claim 1 wherein the parts are constructed and arranged to fit sealingly together.

8. The plastic closure as defined in claim 1 wherein both of the parts are of a conical configuration.

9. The plastic closure as defined in claim 2 wherein both of the parts are of a conical configuration.

10. The plastic closure as defined in claim 3 wherein both of the parts are of a conical configuration.

11. The plastic closure as defined in claim 4 wherein both of the parts are of a conical configuration.

* * * * *